US005272413A

United States Patent [19]

Yamazaki et al.

[11] Patent Number: 5,272,413

[45] Date of Patent: Dec. 21, 1993

[54] FLAT PANEL DISPLAY DEVICE AND A METHOD OF MAKING THE SAME

[75] Inventors: Fumio Yamazaki, Hirakata; Yuichi Moriyama, Ibaragi; Toshifumi Nakatani, Moriguchi; Kanji Imai, Takatsuka, all of Japan

[73] Assignee: Matsushita Electric Industrial Co., Ltd., Osaka, Japan

[21] Appl. No.: 709,225

[22] Filed: Jun. 3, 1991

[30] Foreign Application Priority Data

Jun. 5, 1990 [JP] Japan ..... 2-148241

[51] Int. Cl.[5] ..... H01J 29/46; H01J 29/80

[52] U.S. Cl. ..... 313/495; 313/496; 313/497; 313/422; 313/257

[58] Field of Search ..... 313/495, 496, 497, 444, 313/422, 269, 257, 487

[56] References Cited

U.S. PATENT DOCUMENTS

| | | | |
|---|---|---|---|
| 3,375,391 | 3/1968 | Day | 313/257 |
| 3,643,299 | 2/1972 | Brown | 29/25.16 |
| 4,101,802 | 7/1978 | Adrevski | 313/422 |
| 4,613,399 | 9/1986 | Kobale et al. | 313/495 |
| 4,795,390 | 1/1989 | Gilbert | 445/29 |
| 4,887,000 | 12/1989 | Yamazaki et al. | 313/495 |
| 4,904,217 | 2/1990 | Peters | 445/34 |
| 5,134,338 | 7/1992 | Shiratori et al. | 313/422 |

FOREIGN PATENT DOCUMENTS

| | | |
|---|---|---|
| 60-218750 | 11/1985 | Japan . |
| 2-213034 | 8/1990 | Japan . |
| 2-281544 | 11/1990 | Japan . |

*Primary Examiner*—Donald J. Yusko
*Assistant Examiner*—N. D. Patel
*Attorney, Agent, or Firm*—Wenderoth, Lind & Ponack

[57] ABSTRACT

An electrode structure including a plurality of beam control electrodes, a plurality of electrically insulating spacers disposed between each pair of neighboring members of the beam control electrodes, an electrode substrate, a plurality of metallic pins planted on the beam control electrode so as to extend therefrom through the electrode substrate, and a fixing member mounted on each of the metallic pins from behind the electrode substrate for retaining the beam control electrodes. The electrode structure is manufactured by abutting a first support bench of high rigidity against the beam control electrodes in a predetermined shape and abutting a second support bench of high rigidity in a predetermined shape from behind the electrode substrate, applying a predetermined load to the electrode structure, applying a predetermined load to the fixing member to press the latter towards the electrode substrate, and welding each of the metallic pins and the associated fixing members together by the use of a laser welding process.

6 Claims, 5 Drawing Sheets

FLAT PANEL DISPLAY DEVICE AND A METHOD OF MAKING THE SAME

BACKGROUND OF THE INVENTION

1. Field of the Invention

The present invention generally relates to a flat panel display device utilizing electron beams and, more particularly, to an electrode assembly in the flat panel display device. The present invention also relates to a method of making the electrode assembly in the flat panel display device and to the flat panel display device itself.

2. Description of the Prior Art

In the prior art flat panel display device, use has hitherto been made of glass frit of low melting point to weld major portions of the electron beam control electrodes between electrodes and also to provide electrical insulation between the electron beam control electrodes. According to the prior art structure, the electrostatic capacity between the electron beam control electrodes tends to increase, accompanied by an increase in electric power consumption during operation. The increase in power consumption tends to pose a commercial problem.

In an attempt to substantially eliminate the above described problem inherent in the prior art flat panel display device, the assignee of the present invention has filed a Japanese Patent Application No. 1-33994 which discloses a flat panel display device capable of substantially reducing the electrostatic capacity. The invention disclosed in this Japanese patent application will now be discussed with reference to FIG. 12 of the accompanying drawings which corresponds to FIG. 6 of the Japanese patent application.

Referring now to FIG. 12, reference numeral 1 represents a faceplate having an anode 2 containing phosphor elements which is formed on an inner surface thereof. Reference numeral 3 represents a metallic back enclosure having a peripheral flange secured to the faceplate 1 to thereby complete a highly evacuated envelope. Reference numeral 4 represents wire-like cathodes and reference numerals 6, 7 and 8 represent respective electron beam control electrodes. Reference numerals 9, 10, 11 and 12 represent generally ring-shaped insulating spacers; reference numeral 13 represents an electrode substrate; reference numeral 14 represents an electrode carrier plate; and reference numeral 15 represents fixture pins. Each of the fixture pins 15 is press-fitted into the electrode carrier plate 14. The flat panel display device shown therein is so constructed and so structured that electron beams 16 emitted from the cathodes 4 can pass through the control electrodes 6, 7 and 8 and be subsequently impinged upon the anode 2 to thereby cause the latter to emit light.

The flat panel display device disclosed in the above discussed Japanese patent application is of a design wherein the fixture pins 15 are inserted through the electrode substrate 13 and are, after having passed successively through the electron beam control electrodes 6, 7 and 8, press-fitted into the electrode carrier plate 14. This design has a problem in that, due to the press-fitting of the fixture pins 15 into the electrode carrier plate 14, the electrode carrier plate 14 tends to deform to such an extent as to result in a change in distribution of electric fields. Once the distribution of the electric fields changes as a result of the deformation of the electrode carrier plate 14, respective paths of travel of the electrode beams 16 change, thereby resulting in a reduction of the quality of images being reproduced.

SUMMARY OF THE INVENTION

The present invention is intended to provide an improved flat panel display device wherein use is made of an electrode having a plurality of fixing pins for an electrode structure secured thereto, so that each of the fixing pins can be subsequently welded to the associated fixing member by use of a laser welding technique.

In order to accomplish the above described object, the present invention according to one aspect thereof provides an electrode structure comprising a plurality of beam control electrodes, a plurality of electrically insulating spacers disposed between each pair of neighboring members of the beam control electrodes, an electrode substrate, a plurality of metallic pins planted on the beam control electrode so as to extend therefrom through the electrode substrate, and a fixing member mounted on each of the metallic pins from behind the electrode substrate for retaining the beam control electrodes.

There is also provided a method of making an electrode structure which comprises the steps of abutting a first support bench of high rigidity against the beam control electrodes in a predetermined shape and abutting a second support bench of high rigidity in a predetermined shape from behind the electrode substrate, applying a predetermined load to the electrode structure, applying a predetermined load to the fixing member to press the latter towards the electrode substrate, and welding each of the metallic pins and the associated fixing members together by use of a laser welding process.

Furthermore, there is provided a method of making the flat panel display device utilizing the electrode structure referred to above.

BRIEF DESCRIPTION OF THE DRAWINGS

This and other objects and features of the present invention will become clear from the following description taken in conjunction with a preferred embodiment thereof with reference to the accompanying drawings, in which:

FIGS. 4 to 11 illustrate the sequence of fabrication of an electrode structure used in the flat panel display device embodying the present invention, wherein FIG. 4 is a fragmentary sectional view; FIG. 5 is a diagram showing a step of stacking electrodes one above the other; FIG. 6 is a diagram showing a step of providing the assembly in a pressing means and a step of laser welding; FIG. 8 is a fragmentary sectional view of the electrode structure as viewed along a direction shown by the arrow D in FIG. 6; FIG. 9 is a diagram showing a laser welding step and also showing a sectional view of the electrode structure which has been completed; FIG. 10 is a diagram showing a step of mounting the electrode structure to a glass faceplate; FIG. 11 is a diagram showing a step of securing a back enclosure to the faceplate with the electrode structure housed therein.

DETAILED DESCRIPTION OF THE EMBODIMENT

Figure 1:
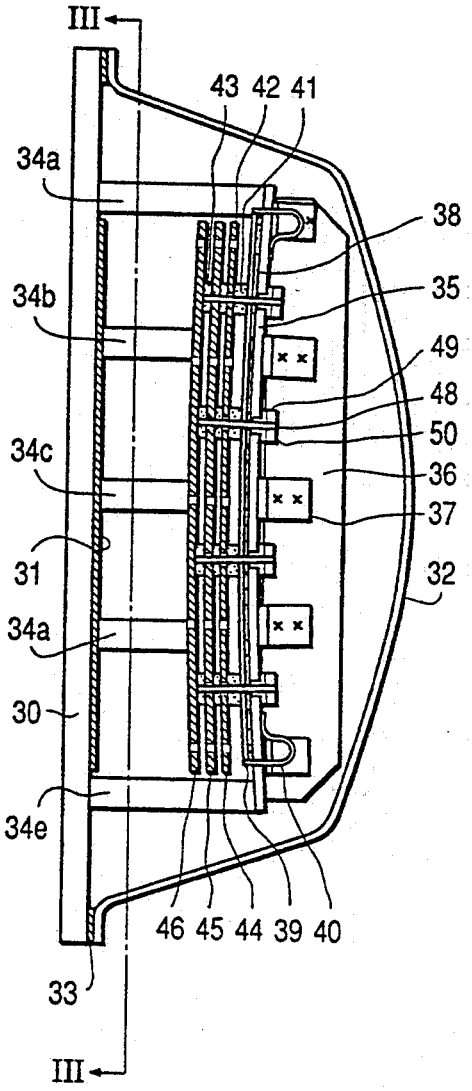
FIG. 1 is a sectional view of an essential portion of a flat panel display device embodying the present invention.
Figure 2:
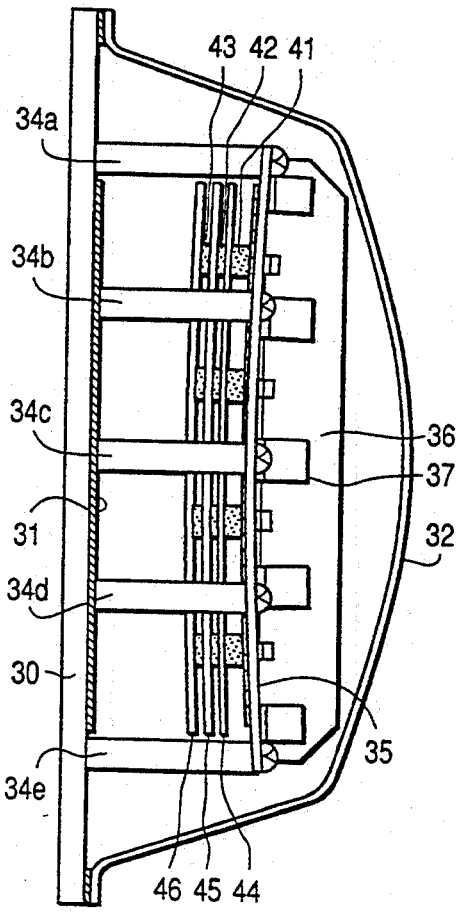
FIG. 2 is a side sectional view of the flat panel display device embodying the present invention.
Figure 3:
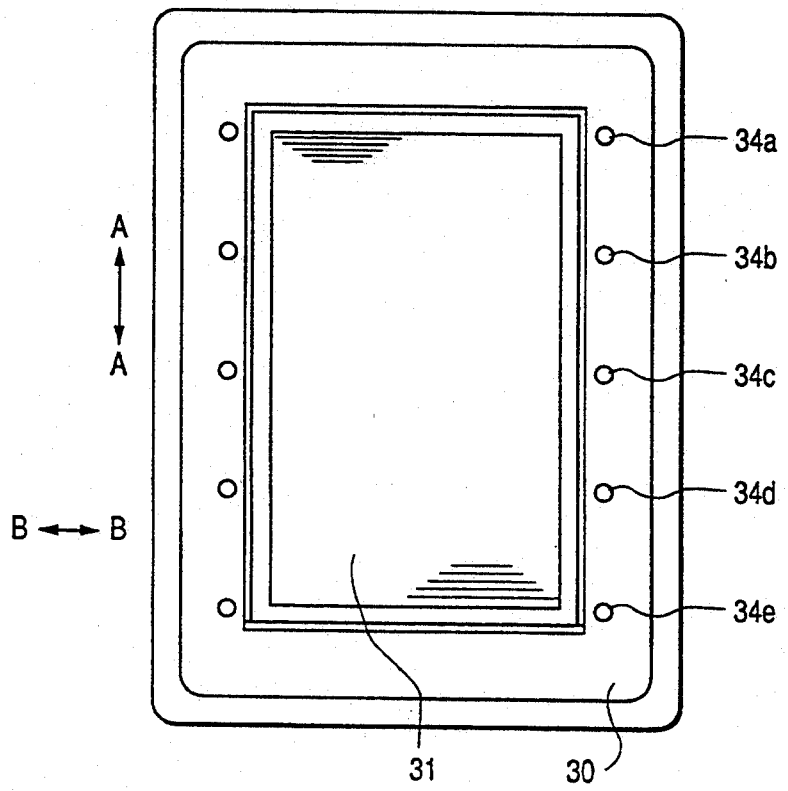
FIG. 3 is a cross-sectional view taken along the line III—III in FIG. 1.

Referring first to FIG. 1, reference manual 30 represents a faceplate having an inner surface deposited with a phosphor layer 31 which serves as an anode. Reference numeral 32 represents a generally done-shaped back enclosure made of metal and having a peripheral flange welded to the faceplate 30 by means of a frit seal 33 to thereby complete a highly evacuated envelope. Reference numerals 34*a* to 34*e* represent respective electrode support posts which are, as best shown in FIG. 3, secured at one end to the faceplate 30 and positioned exteriorly of the perimeter of the phosphor layer 31. As best shown in FIG. 2, the electrode support posts 34*a* to 34*e* have varying heights such that, when viewed along a direction shown by the arrow A in FIG. 3, the electrode support posts 34*a* and 34*e* positioned adjacent respective ends of the phosphor layer 31 have a maximum height while the electrode posts 34*c* positioned intermediate between the electrode support posts 34*a* and 34*e* have a minimum height.

Reference numeral 35 represents an electrode substrate having a rear surface to which ribs 36 are fixed by means of fixtures 37 for increasing the rigidity of the electrode substrate 35. A front surface of the electrode substrate 35 which faces towards the anode, that is, the phosphor layer 31, has a plurality of supports 38 of electrically insulating material arranged thereon at a predetermined pitch. Reference numeral 39 represents filament-like cathodes stretched over the supports 38 by means of springs 40. Reference numerals 41, 42 and 43 represent respective ring-shaped spacers made of electrically insulating material. Reference numerals 44, 45 and 46 represent respective beam control electrodes, each made of a thin metal plate and having a multiplicity of fine perforations for the passage of electron beams therethrough.

Reference numeral 48 represents pins used in the following manner to fix the beam control electrodes 44, 45 and 46. The electrode fixing pins 48 and the beam control electrode 46 are made of metal with the electrode fixing pins 48 connected or welded at one end rigidly with the beam control electrode 46 by the use of a laser welding technique. The electrode fixing pins 48 so welded to the beam control electrode 46 extend through the other beam control electrodes 45 and 44 and also through the electrode substrate 35 and terminate on one side of the electrode substrate 35 opposite to the electrodes 44 to 46. It is to be noted that a spacer 41 for each electrode fixing pin 48 is interposed between the filament-like cathodes 39 and the beam control electrode 44, a spacer 42 for each electrode fixing pin 48 is interposed between the beam control electrode 44 and the beam control electrode 45 and a spacer 43 for each electrode fixing pin 48 is interposed between the beam control electrode 45 and the beam control electrode 46. The electrode fixing pins 48 extending from the beam control electrode 46 and then through the beam control electrodes 45 and 44 and the electrode substrate 35 extend also through the ring-shaped spacers 43, 42 and 41.

Reference numeral 49 represents an electrically insulating sleeve mounted on each of the electrode fixing pins 48. Reference numeral 50 represents rings made of metal and axially slidably mounted on the respective electrode fixing pins 48. Each of these rings 50 serves as a fixing means and has an inner diameter greater than the outer diameter of the associated electrode fixing pin 48 by a quantity within the range of about 0.01 to about 0.06 mm to facilitate an axial sliding motion thereof relative to the associated electrode fixing pin 48. It is, however, to be noted that each of these rings 50 is, after having been mounted on the associated electrode fixing pin 48, fixed thereto by the use of a laser welding technique during the practice of a method of the present invention as will be described subsequently.

The flat panel display device of the above described construction is so designed and so operable that the heating of the cathode 39 can result in emission of electrons which are subsequently passed selectively through perforations in the beam control electrodes 44, 45 and 46 so as to impinge upon the anode 2, then impressed with a high voltage, to emit rays of light. The flat panel display device of a kind referred to above is new and well known to those skilled in the art and, therefore, the operation thereof will not be reiterated herein for the sake of brevity.

Figure 4:
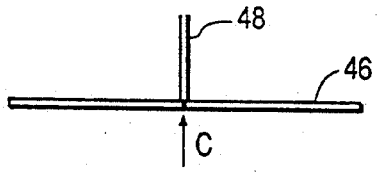

The flat panel display device embodying the present invention is assembled in a manner shown sequentially in FIGS. 4 to 11. With reference to FIG. 4, there is shown a step during which the electrode fixing pins 48 are welded at one end to the metallic electrode plate 46. Specifically, after each electrode fixing pin 48 has been put up on the metallic electrode plate 46 so as to extend generally perpendicular to the electrode plate 46, a laser beam is radiated from a direction shown by the arrow C to a joint between the respective electrode fixing pin 48 and the electrode plate 46 to fusion-connect respective portions of the electrode fixing pin 48 and the electrode plate 46 together. The laser beam used is of a power of 4 joules and is radiated in two shots each being in the form of pulses of 10 PPS.

Figure 5:
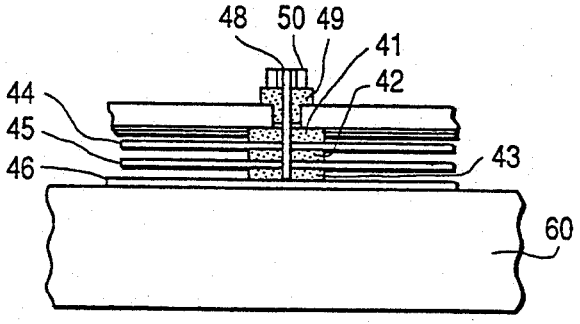

FIG. 5 illustrates a step during which the electrode plate 46 having each electrode fixing pin 48 welded thereto as shown in FIG. 4 is placed on a first support bench 60, which serves as a jig, and the electric insulating spacers 43, 42 and 41 and the electrode plates 45 and 46 are alternately laid on the electrode plate 46. FIG. 5 also illustrates a condition in which, after the electrode substrate 35 has been placed, each electrically insulating sleeve 49 is mounted on the associated electrode fixing pin 48 and each metallic ring 50 is subsequently mounted on the associated electrode fixing pin 48.

Figure 6:
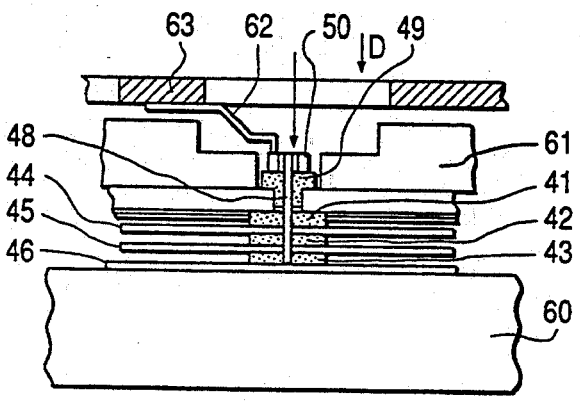

FIG. 6 illustrates a condition in which on a second support bench 61 the electrode substrate 35 is pressed in a direction across the thickness thereof by a predetermined load. A pressing means, comprising a support body 63 and springs 62 fixed to the support body 63, is subsequently set in position so that each ring 50 can be pressed axially of the associated electrode fixing pin 48 by the respective spring 62, followed by radiation of a laser beam to a boundary between the ring 50 and the associated electrode fixing pin 48 while the ring 50 is retained on the associated electrode fixing pin 48 by the action of the respective spring 62. A laser for emitting the laser beam so as to radiate the boundary between each ring 50 and the associated electrode fixing pin 48 is in the form of a YAG laser capable of emitting a laser beam of 1.1 joule energies and the laser beam is radiated in two shots each being in the form of pulses of 10 PPS to give a favorable welding result.

Figure 7:
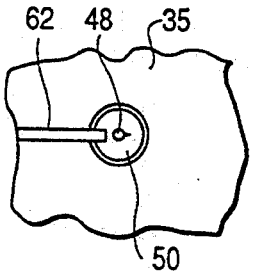

FIG. 7 illustrates an elevational view as viewed in a direction shown by the arrow D in FIG. 6. The weld pattern shown in FIG. 7 in which only a portion of a free end of each metallic electrode fixing pin 48 opposite to the electrode plate 46 is welded to the associated ring 50 is advantageous in that less radiation energy is necessary as compared with a weld pattern wherein the free end of each electrode fixing pin is welded in its entirety, that the amount of thermal expansion of each electrode fixing pin in a direction axially thereof which would otherwise occur during the fusion of the respective electrode fixing pin can be minimized, that the amount of axial contraction after the fusion can be minimized, that any possible variation in fixing forces used to retain the electrodes in stacked fashion can be minimized, and that a highly precisely assembled electrode structure can be obtained. Also, the bonding strength between each electrode fixing pin and the associated ring is enhanced by radiating the laser beam also to another portion of the free end of each electrode fixing pin to connect them together. Thus, where after a portion of the free end of each electrode fixing pin has been fixed to the associated ring another portion of the free end of the respective electrode fixing pin is fused and connected to the same ring in the manner as hereinabove described, any possible deviation in dimension of a portion where the associated electrode fixing pin has been fixed can be substantially eliminated, making it possible to provide a highly precisely assembled electrode structure.

Figure 8:
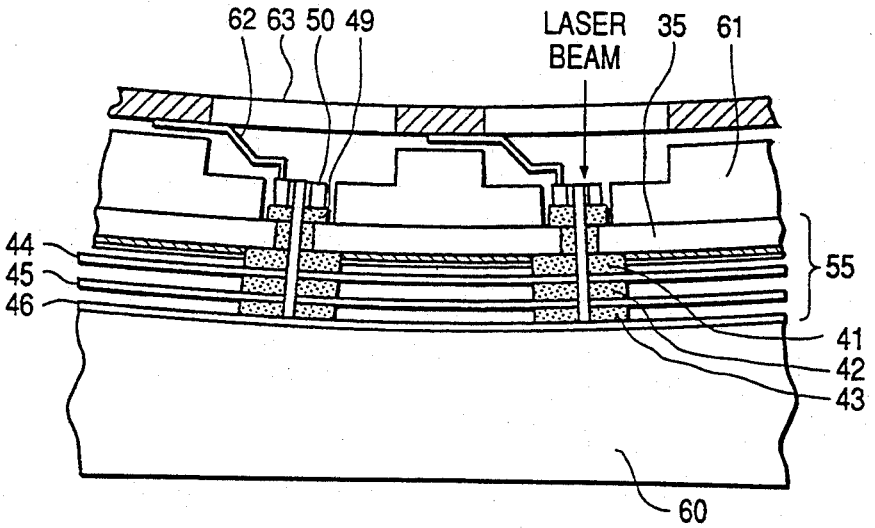

FIG. 8 illustrates a condition in which the welding step shown in and described with reference to FIG. 6 in connection with only one of the electrode fixing pins and its associated ring is carried out in connection with a plurality of the electrode fixing pins 48 and their associated rings 50 simultaneously. In practice, the laser welding is continuously carried out while all of the rings 50 are retained in position by the respective springs 62 as shown in FIG. 8. Also, the first support bench 60 used during the practice of the step shown in FIG. 8 has an inwardly curved support surface on which the beam control electrodes are placed. The second support bench 61 is similarly curved.

Figure 9:
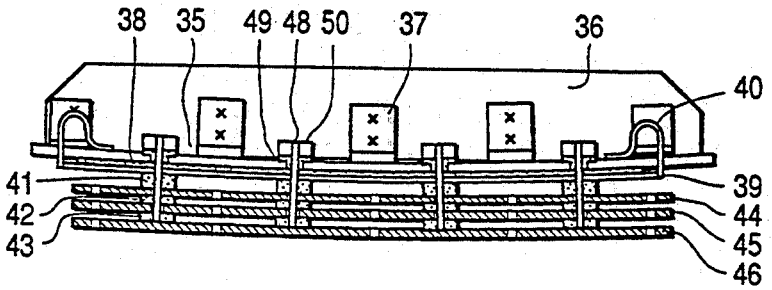
Figure 10:
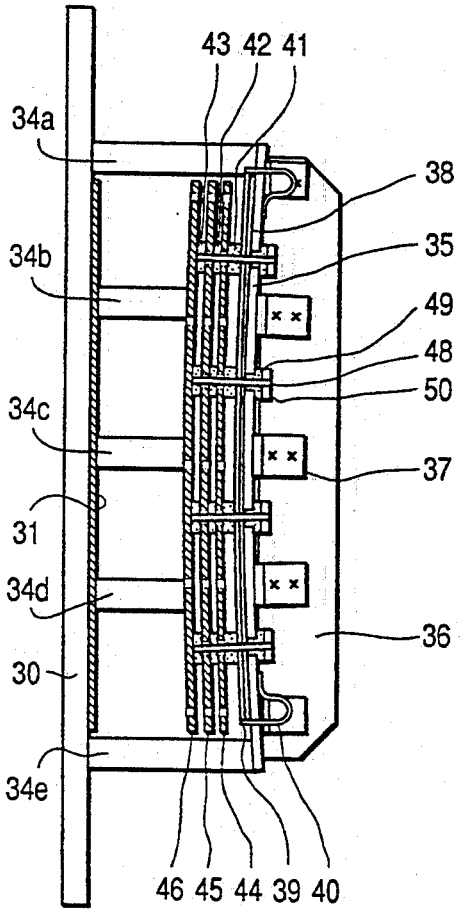
Figure 11:
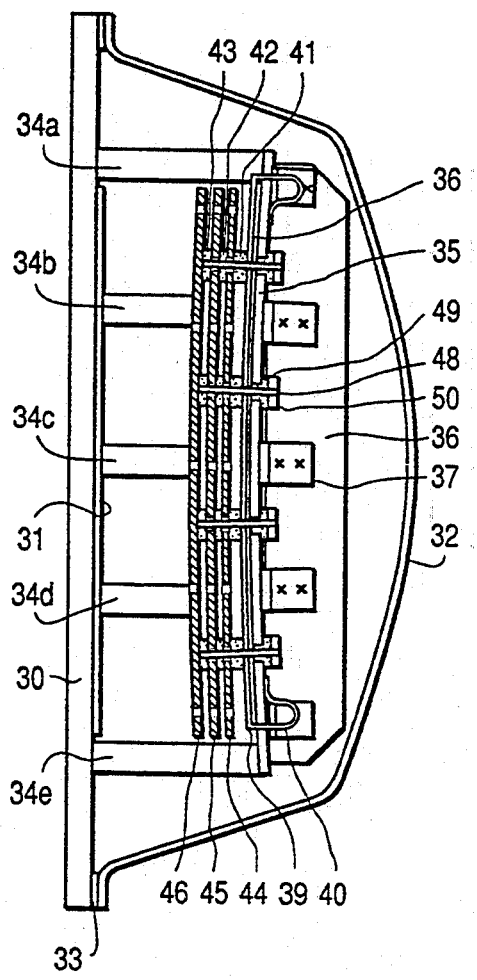
Figure 12:
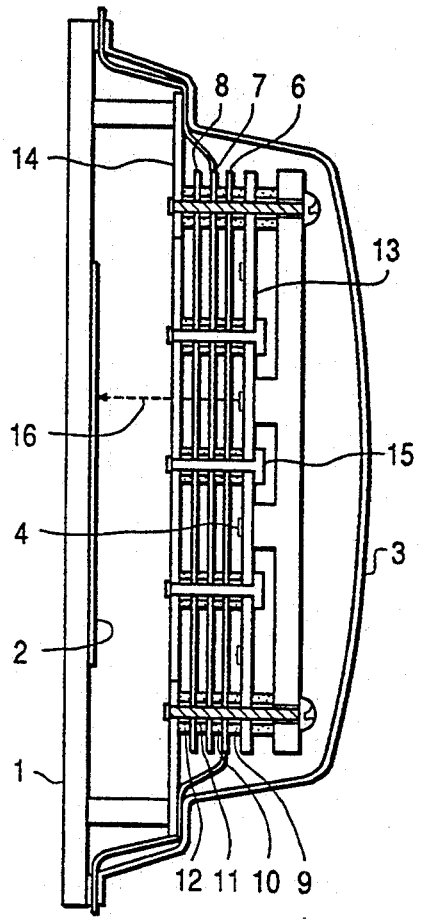
FIG. 12 PRIOR ART
FIG. 12 is a sectional view of the prior flat panel display device.

FIG. 9 illustrates a complete electrode structure 55 left by removing the first support bench 60 and the pressing means including the support body 63 and the springs 63 fixed to the support body 63. FIG. 10 illustrates a condition in which the electrode structure shown in FIG. 9 is mounted on support posts 34*a* to 34*e* which are secured to the faceplate 30 in the manner as hereinbefore described with reference to FIG. 3. FIG. 11 illustrates the assembly of FIG. 10 having been enclosed by the generally dome-shaped metallic back enclosure 32 hermetically sealed to the faceplate 30 through the peripheral flange by means of the glass frit seal 33 to thereby complete the flat panel display device.

From the foregoing description of the present invention, it has now become clear that the beam control electrodes are assembled and connected together by means of the electrode fixing pins and the ring-shaped spacers. In the practice of the present invention, however, when it comes to the connection of the beam control electrodes together with the electrode fixing pins passed therethrough, the laser beam is utilized to fusion-bond the electrode fixing pins and the rings after the electrode fixing pins and the riding rings have been inserted without being accompanied by any stress and any deformation induced therein. Therefore, the present invention is effective to facilitate a manufacture of the electrode structure wherein no physical stress will be set up in the electrodes during the electrode fixing step, thereby making it possible to provide the flat panel display device having the highly precisely assembled electrode structure which is effective to realize a display of high quality images.

What is claimed is:

1. A flat panel display device comprising:

an evacuated envelope;

an electron source mounted in said envelope;

an anode mounted in said envelope, said anode comprising a substantially planar phosphor screen;

a plurality of beam control electrodes, each of which comprises a thin substantially planar metallic plate, mounted in said envelope, each of said electrodes being substantially parallel to other ones of said electrodes and to said phosphor screen and being at least partially superposed over said phosphor screen, a first of said beam control electrodes being disposed closer to said phosphor screen than remaining ones of said beam control electrodes;

a plurality of metallic electrode retaining pins, each of said retaining pins being mounted at a first end thereof to a surface of said first beam control electrode facing said remaining beam control electrodes and each of said retaining pins extending from said first beam control electrode through said remaining ones of said plurality of beam control electrodes at positions thereof superposed over said phosphor screen;

electrically insulating spacers disposed between each pair of adjacent beam control electrodes, said retaining pins extending through said spacers, respectively; and fixing elements fixed to second ends of said retaining pins, respectively, by laser weld deposits formed between said retaining pins and said fixing elements, respectively.

2. A flat panel display device as recited in claim 1, wherein each of said fixing elements comprises a metal ring.

3. A flat panel display device as recited in claim 2, wherein said first ends of said retaining pins are fixed to said surface of said first beam control electrode facing said remaining beam control electrodes.

4. A flat panel display device as recited in claim 3, wherein said first ends of said retaining pins are fixed to said surface of said first beam control electrode facing said remaining beam control electrodes by laser weld deposits respectively formed between said retaining pins and said first beam control electrode.

5. A flat panel display device as recited in claim 1, wherein said first ends of said retaining pins are fixed to said surface of said first beam control electrode facing said remaining beam control electrodes.

6. A flat panel display device as recited in claim 1, wherein said first ends of said retaining pins are fixed to said surface of said first beam control electrode facing said remaining beam control electrodes by laser weld deposits respectively formed between said retaining pins and said first beam control electrode.

* * * * *